United States Patent [19]

Byrne

[11] 4,062,658

[45] Dec. 13, 1977

[54] COMPOSITION AND METHOD FOR REPAIRING SELENIUM PHOTORECEPTORS

[75] Inventor: John Frank Byrne, Worthington, Ohio

[73] Assignee: Xerox Corporation, Stamford, Conn.

[21] Appl. No.: 610,036

[22] Filed: Sept. 3, 1975

[51] Int. Cl.[2] ..... B24B 37/04

[52] U.S. Cl. ..... 51/281 R; 51/306; 51/308; 51/309 R

[58] Field of Search ..... 51/306, 308, 309, 281, 51/283

[56] References Cited

U.S. PATENT DOCUMENTS

| | | | |
|---|---|---|---|
| 2,114,166 | 4/1938 | Leeuw | 51/308 |
| 2,944,878 | 7/1960 | Allen et al. | 51/308 |
| 3,071,455 | 1/1963 | Harman et al. | 51/308 |
| 3,607,160 | 9/1971 | Makino et al. | 51/306 |
| 3,715,842 | 2/1973 | Tredinnick et al. | 51/308 |
| 3,807,979 | 4/1974 | Cromwell | 51/308 |
| 3,874,129 | 4/1975 | Deckert et al. | 51/308 |
| 3,959,934 | 6/1976 | Byrne | 51/308 |
| 3,971,169 | 7/1976 | Byrne | 51/308 |

*Primary Examiner*—Donald J. Arnold

[57] ABSTRACT

Disclosed are compositions and a method for repairing a damaged electrostatographic photoreceptor comprised of a conductive substrate with a uniform layer of selenium or a selenium alloy on its surface. The instant compositions contain amorphous silica of three distinct particle sizes. Scratches in the selenium layer of a depth less than its total thickness are polished with the instant composition whereby the affected surface area is buffed to a smooth finish. After application of the polish composition, the electrostatic effects of the original scratch are eliminated and the repaired photoreceptor will provide copies in which printout in the repaired areas is of the same quality as in the non-damaged areas.

8 Claims, No Drawings

COMPOSITION AND METHOD FOR REPAIRING SELENIUM PHOTORECEPTORS

BACKGROUND OF THE INVENTION

The process of electrostatographic copying, as originally disclosed by C. F. Carlson in U.S. Pat. No. 2,297,691, involves the uniform electrostatic charging of a layer of photoconductive material dispersed on a conductive substrate with subsequent exposure of the charged layer to light and shadow to selectively discharge the photoconductive layer and thereby form a latent electrostatic image on the surface of the layer corresponding to the shadow areas. The latent image is developed by contacting the layer with a particulate electroscopic marking material, commonly referred to as toner, which adheres to the non-discharged areas and can be transferred to a receiving member such as paper in imagewise configuration.

The conductive substrate and layer of photoconductive material, which normally contains a resistive barrier layer between the substrate and photoconductive material and may have a protective overcoating on the surface of the photoconductive layer, is generally referred to as the photoreceptor. Typically, the photoconductive material used in photoreceptors is amorphous selenium or an alloy thereof. As is well known, amorphous selenium and selenium alloy photoreceptors are sensitive materials, being easily scratched or electrically affected by foreign objects or human hand contact.

Photoreceptors are easily damaged in field use such as by paper scratching and handling damage which may occur when the photoreceptor is installed or serviced. In addition, foreign matter such as paper clips may come into contact with the photoreceptor during the copying process and gouge the layer of photoconductive material. The damaged photoreceptor is left with depressions on its surface which reduce copy quality. In the case where the depression is deep enough so as to protrude through the photoconductive material to the conductive substrate, the damaged area cannot hold a charge and will not contribute to the formation of the latent image. Less severe scratches which do not form depressions through the entire thickness of the photoconductive layer may be revealed on the finished copy. Copy quality can be reduced initially since the photoconductive material remaining in the damaged area may have a contrast potential less than the sensitivity of the system. In addition, as the imaging and development cycle is repeated, toner particles tend to build up in the depressions since ordinary photoreceptor cleaning techniques are effective in removing toner only when it is on a relatively smooth surface. The buildup of toner particles, which are normally non-conductive, results in damaged areas retaining their charge during exposure and thereby forming part of the latent image. These areas are developed along with the rest of the latent image and ultimately show up as dark areas when the toner is transferred from the photoreceptor to the paper.

As the photoreceptor receives progressively more scratches, it reaches a point where copy quality is unacceptable whereupon it must be replaced or repaired with the latter option obviously being preferred. One method of repairing selenium based photoreceptors involves buffing the damaged areas to physically remove the depression by abrading away the photoconductive material in the scratched area down to a thickness commensurate with the total layer thickness less the depth of the depression. While various polishes and buffing agents have been utilized in selenium repair they have been found unsatisfactory for many reasons. Some are too abrasive resulting in damage to the affected area of application. Others contain constituents which leave a film on the selenium photoreceptor surface resulting in an electrostatically occluded area. Additionally, some buffing compositions required more than ordinary technique and care thereby rendering them unsatisfactory for field application, i.e., in offices and any other places where copiers are placed.

In copending application Ser. No. 512,803 now U.S. Pat. No. 3,971,169, and 512,804 now U.S. Pat. No. 3,959,934, both filed on Oct. 4, 1974 there is disclosed an abrasive composition which overcomes many of the disadvantages noted above. The compositions disclosed primarily utilize feldspar as the abrasive additive. The present invention relates to the use of a particular abrasive of distinct particle size which improves on the compositions of the copending applications.

BRIEF SUMMARY OF THE INVENTION

The present invention relates to a method for the repair of an electrostatographic photoreceptor comprised of a conductive substrate with a uniform dispersion of selenium or a selenium alloy on its surface as the photoconductive layer in which the photoreceptor has been damaged by the formation of a scratch, fissure, aggravated surface conductivity, or depression partially through the photoconductive layer. The composition of the instant invention includes a mixture of a primary suspending agent, and an abrasive dispersed in a liquid medium, the abrasive being amorphous silica of three distinct particle sizes. The liquid medium generally comprises an aliphatic hydrocarbon liquid and alcohol. The method of the instant invention involves: (a) providing a composition comprising a mixture of a primary suspending agent and small particles of amorphous silica, both materials being suspended in a liquid medium; (b) applying the composition to a physically damaged area of a selenium or selenium alloy photoreceptor; and (c) rubbing the composition about the damaged area so as to effect a smoothing of the physically damaged area of the photoreceptor.

DETAILED DESCRIPTION OF THE INVENTION

Typically, the photoreceptors which are repaired by the process of the present invention comprise selenium which has been vapor deposited under vacuum onto an aluminum drum having an insulating barrier layer of aluminum oxide on its surface. In another embodiment, the selenium is deposited on a flexible nickel belt having a resistive polymer coating on its surface as the barrier layer. As used herein, the term selenium is intended to refer to amorphous elemental selenium or an alloy thereof. Examples of selenium alloys useful in photoreceptors are the selenium/arsenic alloy disclosed by Ullrich in U.S. Pat. No. 2,803,542 and the selenium/arsenic alloys doped with halogen disclosed by Straughan in U.S. Pat. No. 3,312,548.

Commercial photoreceptors of the type which can be repaired by the method of the present invention normally have a layer of selenium or selenium alloy of from 50 to 70 $\mu$ in thickness on the conductive substrate. Repair of scratches in the selenium surface has been problematical due to the difficulty of providing a material which can be applied to the damaged areas which has discharge characteristics similar to the selenium. As used herein, discharge characteristics is a term intended to refer to various characteristics of a photoconductive material such as spectral response, quantum efficiency, dark decay and dark dielectric constant. Alternatively, polishes or rubbing compositions have proven unsatisfactory for reasons already give above.

The composition of the present invention includes a primary suspending agent such as magnesium hydroxide or zinc oxide and fine particles of amorphous silica dispersed in a suitable liquid medium. As mentioned above, the amorphous silica is of three different size ranges. Therefore, the small grit polish composition has amorphous silica of particle sizes up to five microns (5 μ). The medium grit polish has amorphous silica of particle sizes of up to ten microns (10 μ). The large grit polish has amorphous silica particles of sizes of up to fifteen microns (15 μ). Each of these polishes have distinct characteristics that renders them amenable to a particular utility in the polishing of selenium photoreceptors. Therefore, one grit size is found more effective than the other two with regard to a particular selenium composition.

The liquid medium for the present composition generally includes an alcohol, such as isopropyl alcohol and an aliphatic hydrocarbon liquid such as odorless mineral spirits. Generally, the composition should comprise 25 to 200% abrasive based on the weight of the suspending agent. The solvent for the present compositions generally has a higher proportion of aliphatic hydrocarbon liquid over the alcohol but there may be equal parts of both. Additionally, a small amount of propylene glycol can be added to prevent premature drying of the composition during use.

Secondary suspending agents may be used within the purview of the present compositions. Suitable secondary suspending agents for the present composition include Santocel Z supplied by Monsanto Corporation of St. Louis, Mo. Other suitable secondary suspending agents include Cabosil supplied by the Cabot Corporation.

A preferred technique for utilizing the instant composition to repair a damaged selenium photoreceptor is simply to apply it on the damaged area with a soft gauze cloth. Sufficient material is applied to cover the area of the depression or scratch so that upon subsequent rubbing or buffing a smooth surface containing no bumps or depressions is provided. Subsequent to buffing any excess material should be removed to avoid any residual accumulation of the polish and thereby provide a substantially smooth surface. After application and removal of the polish the photoreceptor can be ventured to service.

While the mechanism which renders the instant polishes optimum in repairing selenium photoreceptors is not completely understood, it is speculated that the amorphous silica has a relatively uniform crystalline structure free from sharp edges which allows smoother polishing of selenium than previous polishes.

A person skilled in the art who seeks to repair a given selenium photoreceptor having damage in the form of depressions, scratches, or cracks in its surface of a given depth will realize that he must apply the instant composition for a time period commensurate with the damage.

These and other aspects of the present invention are further illustrated by the following examples in which all parts are by weight unless otherwise specified.

EXAMPLE I

An electrostatographic photoreceptor consisting of an aluminum cylinder, 8 inches in diameter and 12 inches long, with a uniform 60 μ layer on its surface of a photoconductive selenium alloy containing 0.33% As and 20 ppm chlorine, is scratched to a depth of about 20 μ. The photoreceptor is used in the normal xerographic mode with unsatisfactory results due to toner buildup in the depressions created by the scratches with consequent failure to discharge in these areas causing them to appear as black marks on the copies produced. The toner is first removed from the scratches by wiping with a cloth or by use of a cotton swab wetted with isopropyl alcohol.

A polish composition of the instant invention having amorphous silica particles of up to 15 microns in size utilizes the following ingredients:

20 g. of zinc oxide such as that supplied by the New Jersey Zinc Co. under the brand name Kadox-25.

320 g. of amorphous silica abrasive (Neosil-XV, supplied by Tammsco Incorporated). The above composition is mixed with a solvent of 400 mls of Sohio solvent and 400 mls of isopropyl alcohol. The mixture is stirred to form a thick paste.

The specific preparation of the composition is as follows:

a. add 320 grams of the Neosil-XV to 400 mls of Sohio solvent (SOS, odorless mineral spirits) in a polyethylene jar and disperse the amorphous silica by shaking;
b. add 200 mls of isopropyl alcohol to the above prepared solution and further hand shake in the polyethylene jar;
c. take half of the prepared solution and add 20 grams of Kadox (ZnO) and some ⅛ inch mullite beads and shake the mixture in a paint shaker for one minute;
d. filter to separate the steel pellets and combine with the other half of the original SOS-amorphous silica solution; and
e. add 200 mls more of isopropyl alcohol and hand shake in a polyethylene jar.

The paste is then applied to the 20 μ scratch on the photoreceptor referred to above by means of a gauze cloth, a soft sponge, or alternatively, a cotton pad. The damaged area is rubbed vigorously, with further liberal application of paste, with continual scrutiny of the damaged area. When the crack appears relatively smoothed, the buffing is terminated and the residual polish, contaminated with particles of the selenium alloy, removed. The damaged area of the photoreceptor demonstrates a smooth scar in place of the original scratch.

The repaired photoreceptor is employed to produce copies in the normal xerographic mode. Inspection of the copies produced discloses that the scratched area which appeared black before repair now are undetectable. The image areas on the copies are uninterrupted since the repaired area has discharge properties substantially equivalent to the undamaged areas of the photoreceptor.

EXAMPLE II

An endless nickel belt, 65 inches in diameter, 16½ inches wide and 4.5 mils thick having a polymeric barrier layer on its surface covered with a uniform 60 μ thick layer of a selenium alloy containing 0.33% As and 100 ppm chlorine, is scratched to provide depressions of approximately 5 μ in depth. The damage is repaired in the same manner, as Example I using a composition containing amorphous silica particles of up to 10 microns (Neosil A supplied by Tammsco Incorporated). Copies made in the xerographic mode after repair contain no deletions or dark marks in the scratched areas. This is contrasted with copies made before repair wherein the copy areas corresponding to the scratched portions of the photoreceptor appear as black lines.

It is to be noted that optimum results are obtained in Example I using a polish having up to 15 microns of amorphous silica while optimum results were obtained in Example II by using up to 10 microns size particles of amorphous silica in the polish. These results correspond to the different selenium alloy used in each case. With any selenium photoreceptor one of the three polishes disclosed herein will provide optimum buffing and repair.

Unless otherwise specified all percentages used in the instant application are by weight.

What is claimed is:

1. A composition for repairing damaged selenium photoreceptors consisting essentially of:

a. a primary suspending agent, being one of zinc oxide or magnesium hydroxide or a mixture of both; and b. small particles of amorphous silica, both items being suspended in a liquid medium selected from an alcohol, an aliphatic hydrocarbon and mixture thereof.

2. The composition of claim 1 wherein the amorphous silica has a particle size range of up to 15 microns.

3. The composition of claim 1 wherein the amorphous silica has a particle size of up to 10 microns.

4. The composition of claim 1 wherein the amorphous silica has a particle size of up to 5 microns.

5. A method for repairing a damaged area on a selenium photoreceptor comprising:

a. providing a polish composition consisting essentially of (i) a primary suspending agent, being one of zinc oxide or magnesium hydroxide or a mixture of both; and (ii) small particles of amorphous silica, both materials being suspended in a liquid medium selected from an alcohol, an aliphatic hydrocarbon and mixture thereof;

b. applying the polish composition to a physically damaged area of a selenium photoreceptor; and c. rubbing the polish composition about the damaged area so as to effect a smoothing of the physically damaged area of the photoconductor.

6. The method of claim 5 wherein the amorphous silica has a particle size range of up to 15 microns

7. The method of claim 5 wherein the amorphous silica has a particle size of up to 10 microns.

8. The method of claim 5 wherein the amorphous silica has a particle size of up to 5 microns.

* * * * *